US006192962B1

(12) United States Patent
Glover

(10) Patent No.: US 6,192,962 B1
(45) Date of Patent: Feb. 27, 2001

(54) APPARATUS FOR HANGING INTERCHANGEABLE WINDOW TREATMENT PANELS

(76) Inventor: Elizabeth Alice Glover, 401 Family Cir., Hutto, TX (US) 78634

( * ) Notice: Subject to any disclaimer, the term of this patent is extended or adjusted under 35 U.S.C. 154(b) by 0 days.

(21) Appl. No.: 09/116,749

(22) Filed: Jul. 16, 1998

(51) Int. Cl.[7] ..... A47H 1/00

(52) U.S. Cl. ..... 160/126; 160/330; 160/368.1; 160/38; 211/105.3; 248/262

(58) Field of Search ..... 160/123, 126, 160/368.1, 330, 38, 39, 19; 211/105.1, 105.3; 248/262

(56) References Cited

U.S. PATENT DOCUMENTS

| | | | | |
|---|---|---|---|---|
| 572,249 | * | 12/1896 | Eckert | 160/330 |
| 1,199,673 | * | 9/1916 | Donovan | 160/126 |
| 1,764,611 | * | 6/1930 | Delisle | 160/126 |
| 1,813,556 | * | 7/1931 | Young | 211/105.1 |
| 3,996,987 | * | 12/1976 | Rodriguez | 160/330 |
| 4,782,883 | * | 11/1988 | Braitta | 160/368.1 |
| 5,074,348 | * | 12/1991 | Phillips | 160/38 |
| 5,205,337 | * | 4/1993 | Bozzo | 160/330 |
| 5,295,595 | * | 3/1994 | Gobidas et al. | 160/330 |
| 5,335,709 | * | 8/1994 | Borzi | 160/39 |
| 5,597,025 | * | 1/1997 | Forkner . | |
| 5,673,741 | * | 10/1997 | Cairns | 160/330 |

FOREIGN PATENT DOCUMENTS

| | | | | |
|---|---|---|---|---|
| 2397177 | * | 3/1979 | (FR) | 160/39 |
| 1078248 | * | 8/1967 | (GB) | 160/126 |
| 2252033 | * | 7/1992 | (GB) | 160/368.1 |

* cited by examiner

*Primary Examiner*—Blair M. Johnson
(74) *Attorney, Agent, or Firm*—Coats & Bennett, PLLC

(57) ABSTRACT

An improved method and apparatus for displaying functional or decorative window treatments which permits one person to form and modify the window treatment without requiring specialized skills or training. The preferred method uses hook and loop type fastening means to secure various window treatment panels to an adjustable telescoping support bar such that a means is attached to all sides of the bar, and a means is attached to a portion of each window treatment panel. The invention permits multiple window treatment panels to be attached to a single support bar in a manner that achieves an overlapping of panels in multiple layers on a single rod. Interchangeable panels permit frequent reconfiguration of the panels.

11 Claims, 26 Drawing Sheets

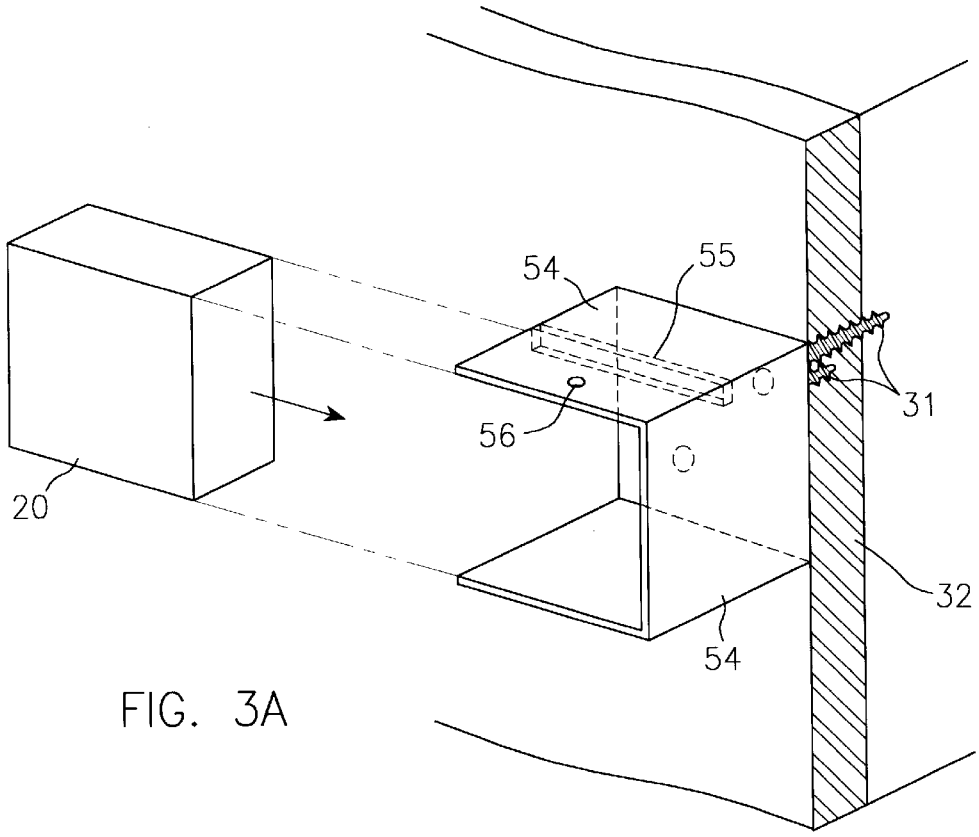
FIG. 3A
FIG. 3B
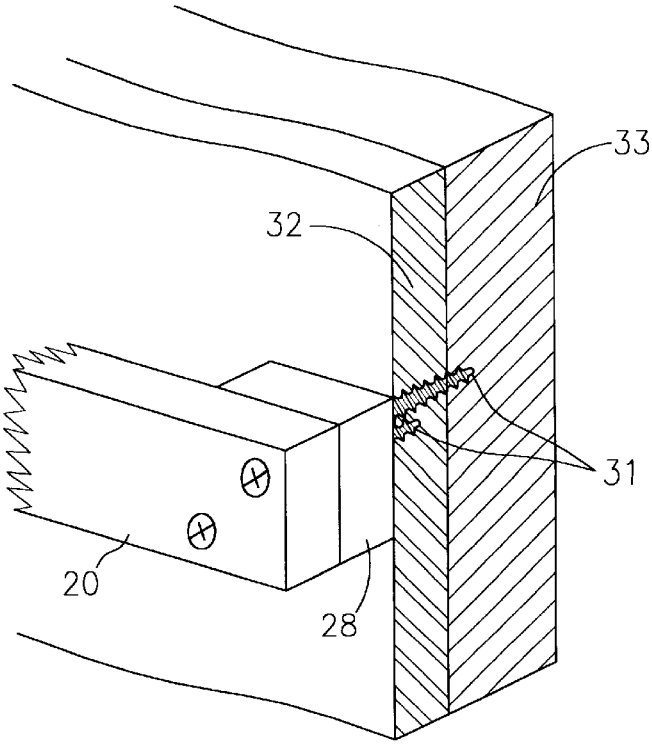

APPARATUS FOR HANGING INTERCHANGEABLE WINDOW TREATMENT PANELS

FIELD OF INVENTION

This invention relates to an improved method of supporting and displaying window treatment panels.

BACKGROUND

This invention relates to a method for hanging curtain panels to provide a custom designed wall or window treatment quickly and inexpensively. Typically a window treatment curtain is hung by means of pockets, staples, or tacks, from a horizontal rod or cornice board attached to the wall over a window. Multiple rods are required to obtain a layered effect with existing support methods. The conventional method also requires the entire window treatment to be attached to the support means before hanging the panels on the wall. The size and weight of the panels often requires two people to hang the panels in a conventional manner. The present invention overcomes these problems by providing a method that one person can hang and overlay multiple curtain sections on a single support which has been previously attached to the wall.

Curtains and draperies are typically hung by hooks, rings, or a rod pocket supported by a rod or cornice board. In the event that a layered look is desired, the conventional technique is to use multiple rods or complex rods in order to support the multiple layers.

The disadvantages in the conventional presentation techniques are that the equipment is relatively expensive, that it is difficult to properly hang the window treatments, and that the complexity of the technique is such that the treatments are not routinely modified.

One object of the present invention is to present a hook and loop attachment means integral to both the window treatment and the support means so that window treatment panels can be easily installed and removed by one person. Another object of the present invention is to present universal panel types to window treatment supports that can be coordinated in a variety of shapes, sizes, and prints with a single layer, or can be combined to create a layered effect.

Another object of the current invention is to provide easily interchangeable panels for varying the seasonal window treatment.

Another object of the current invention is to provide a width-adjustable support bar which provides temporary attachment surfaces on all surfaces of the support bar.

In the preferred embodiment, a rectangular cross-section, adjustable-width, support bar is substantially covered with a hook and loop attachment means, and window treatment panels have a complementary hook and loop attachment means so that the panels, curtains, wall hangings, tapestries, banners, quilts, and swags can be hung on various portions of the support bar. This hanging device can be used for many types of decorative or functional window treatments.

The support means may include flat rods, round rods, square rods, arched rods, triangular rods, rectangular rods, other polygonal rods, cornice boards, pipes, tubes, dowels, or boards of various shapes and sizes and shelves. The support means may be fixed in length, or may be telescoping to provide an adjustable length. The support means may be constructed from wood, metal, plastic, bendable pipe, PVC pipe, metal pipe, dowels, other synthetic material, or any other type of suitable material.

The window treatment panels are preferably attached to the support means with a hook and loop attachment means. Typically, each panel has a hook or loop strip, patch or series of strips or patches sewed or glued to the front or back of the panel. The panel or panels will then adhere to the support means with the hook and loop attachment.

One purpose of the hook and loop attachment means of hanging the window treatment panels is the ease in hanging the support bar first and then applying either a decorative or functional window treatment. Another objective is to provide a method that permits a simple removal of the treatment from the support for cleaning without having to take down the rod. Another purpose is that all sides or planes of the support bar are functional, thereby providing a multi-layered appearance capability with the use of only one bar or rod. Seasonal applications such as Christmas, Thanksgiving, spring, fall, and summer curtains, banners, quilts, can easily be interchanged without removing the rod from the wall. Similarly, the invention permits an easy way to change the decor in a child's room as the child matures.

The consumer has the ability to use creativity to mix, match and create his or her own designs and styles as the panels are available individually rather than in sets. The panels can be constructed to be reversible for additional variety in decor. The panels are interchangeable for economy in redecorating a room. An example is that if the end panels are floral printed and the center valances are plaid, the plaid valances could still be used while the end panels are exchanged for a different print, or the plaid panels could be used in a different room with new end panels.

The prior art includes references to hook and loop attachment means. U.S. Pat. No. 5,146,972 to W. Tacchella discloses a hook and loop fasting means as part of a method to provide a curved arc window treatment. U.S. Pat. No. 5,544,692 issued on Aug. 13, 1996 to McMichael discloses curtain draping hardware and method for draping curtains.

U.S. Pat. No. 5,673,741 issued on Oct. 7, 1997 to J. Cairns discloses a bracketed telescoping rod with hook and loop attachment surfaces indented within a portion of the front and top of the telescoping portion of the rod and on the front and top of the fixed portion of the rod. An object of the present invention is to provide more attachment surfaces in order to permit more elaborate window treatments and additional layers of panels.

In the preferred embodiment, an adjustable support bar is provided with attachment surfaces integral to all exposed exterior surfaces so that window panels may be attached to all exterior surfaces of the support bar. In an alternative embodiment, a strong and economical fixed bar with a large attachment surfaces integral to all exposed exterior surfaces is provided so that elaborate widow treatments may be displayed from a single support bar.

The terms rod and support bar are generic descriptions of support means, and it is obvious to those skilled in the art that many types of supports may be employed in the invention. Similarly, although many types of window treatment shapes are described, the invention is applicable to other shapes that are obvious to one skilled in the art of decoration. Terms such as front, rear, top, bottom, left, and right are used to communicate the nature of the invention and not to restrict its application.

SUMMARY

An improved method for hanging and layering multiple curtains or curtain panels on a single curtain support without requiring specialized skills, tools or training. The method described below allows multiple curtain panels to be draped from a curtain support in a decorative manner about a window opening. The preferred embodiment uses hook and loop type fastening means to secure the curtain panels to the curtain support.

BRIEF DESCRIPTION OF THE DRAWINGS

These and other objects and advantages of the present invention are set forth below and further made clear by reference to the drawings, wherein:

FIGS. 3A–3B are front perspective views of wall attachment means.

DESCRIPTION OF THE PREFERRED EMBODIMENT

Figure 1:
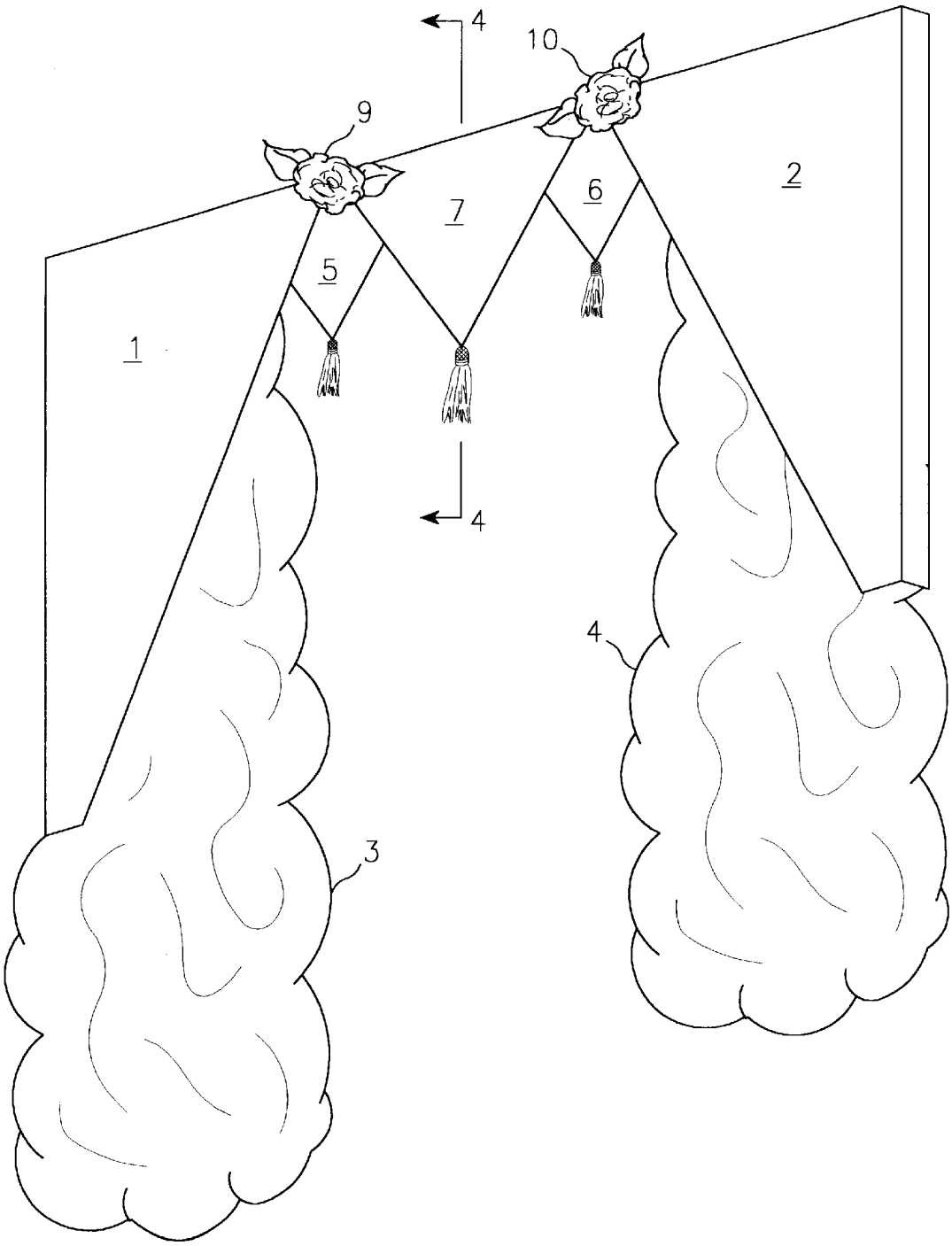
FIG. 1 is a front view of an elaborate implementation of a window treatment.

Referring now to FIG. 1, an elaborate window treatment with multiple window treatment panels with decorations is illustrated. The various window panels include a left gingerbread panel 1 which is attached to the front surface of a support bar and also attached to the left end surface of the bar. The gingerbread panel makes a right angle with respect to the window wall. The gingerbread panels are prepared by attaching the panels to the ends of the bar and wrapping the panels around the edge of the bar while aligning the crease lines to the corner of the support bar. The crease lines are prepared by pressing the panels with a hot iron to prepare a sharp crease. A similar right gingerbread panel 2 is attached to the front surface of the bar and to the right end surface of the bar.

A left lace panel 3 and a right lace panel 4 are attached to the bottom surface of the bar. A left small rick rack 5 and a right small rick rack 6 are attached to the back surface of the bar, thereby creating a depth between the gingerbread panels and the rick rack panels. The center large rick rack panel 7 is attached on the top surface of the bar. The larger rick rack panel has a narrow lip which is substantially perpendicular to the main panel, so that the lip can be attached to the top of the support bar. Additional decorations, the rosettes 9 and 10, are attached to the front surface of the bar between the larger rick rack panel and the gingerbread panels.

Figure 2A:
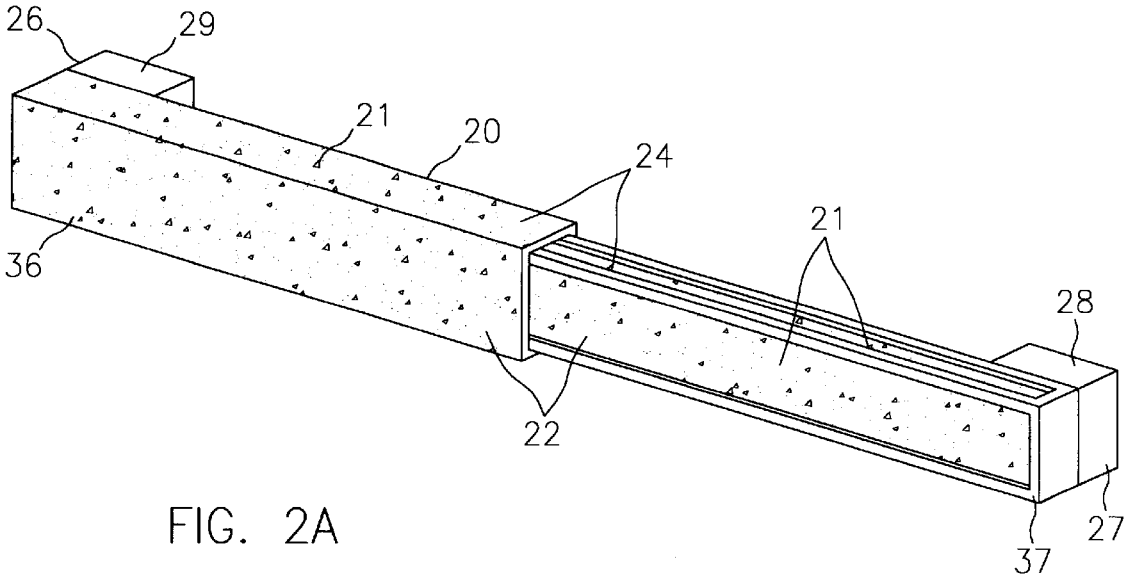
FIG. 2A is a perspective view of a rectangular adjustable support rod.
Figure 2B:
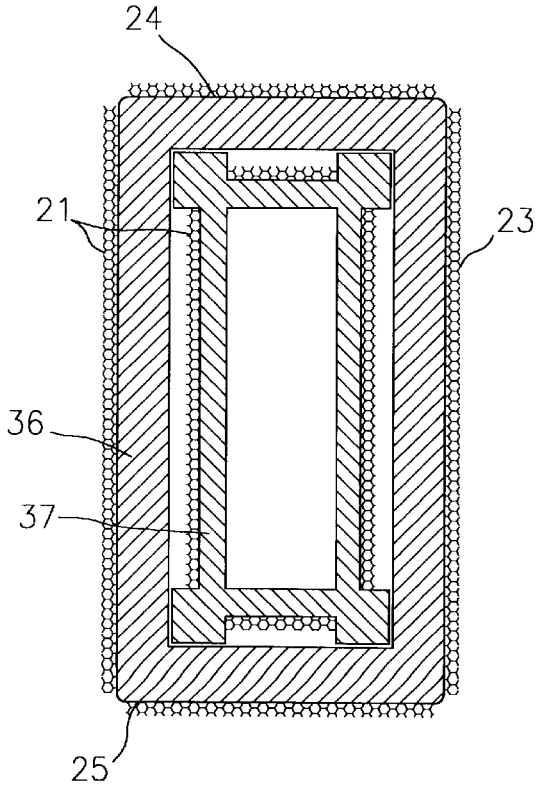
FIG. 2B is side view of a rectangular adjustable support rod.

Referring now to FIGS. 2A and 2B, the preferred support means is accomplished with an adjustable rectangular support bar 20 having the hook portion of a hook and loop attachment means 21 substantially covering all surfaces of the support bar. The adjustable bar includes an outer hollow rectangular section 36 and an inner hollow rectangular section 37 which slides within the hollow outer section. The bar is mounted to the wall with standard brackets or through a right mounting block 28 and a left mounting block 29. Both sections of the support rod include a front surface 22, a rear surface 23, a top surface 24, a bottom surface 25. The support rod also includes a left end surface 26, and a right end surface 27. The preferred dimensions of the support bar for windows up to 3 feet in width is approximately 2 inches in height, 1 inch in depth, and a length that is generally about 2 to 3 inches wider than the window on each side of the window. The preferred material of construction is an extruded polymer such as PVC, polypropylene, or polyethylene. Alternative materials include other plastics, aluminum, fiberglass, or any material or composition that has sufficient strength to support the curtain panels. The outer section of the support bar is covered with the hook and loop attachment fabric. The fabric is preferably glued to the support bar. The inner section of the support bar is indented approximately ⅛" along each surface, and the fabric is attached within the indention.

Alternatively, the inner section may include non-indented surfaces with fabric attached to the entire surface. In this case, the inner section dimensions are about 3/16" less than the outer section to permit attachment of the fabric where the inner section can slide into the outer section.

Referring now to FIG. 3B, the bar width permits attachment of the support bar 20 into the window's wood framing studs with most construction. One method of mounting the support rod is through a mounting block 28 which is typically glued to the end of the back of the support bar or formed with the bar. The function of the mounting block is to provide an offset between the window wall and the support device to permit a three-dimensional effect to the window treatment. The mounting blocks have a preferred width of about 3 inches, a thickness of about 1 inch, and a height equivalent to the support bar. The adjustable support bar inner and outer sections are preferably solid along at least the last 3 inches at the mounting ends in order to provide a material to secure the mounting bolts or screws. In the event that the support bar is secured to a wood stud 33, the preferred wall attachment means is wood screws 31. The mounting holes are preferably pre-drilled and countersunk. Other standard attachment means such as expanding sheetrock bolts may also be used.

Referring now to FIG. 3A, the support bar can be mounted with conventional means such as an end plate 54. The end plate is typically formed in a c-shape to receive the end of the support bar, which is held at an offset from the wall by a tab 55 or a set screw 56. The end plate is mounted on the wall with screws or bolts 31.

Figure 4:
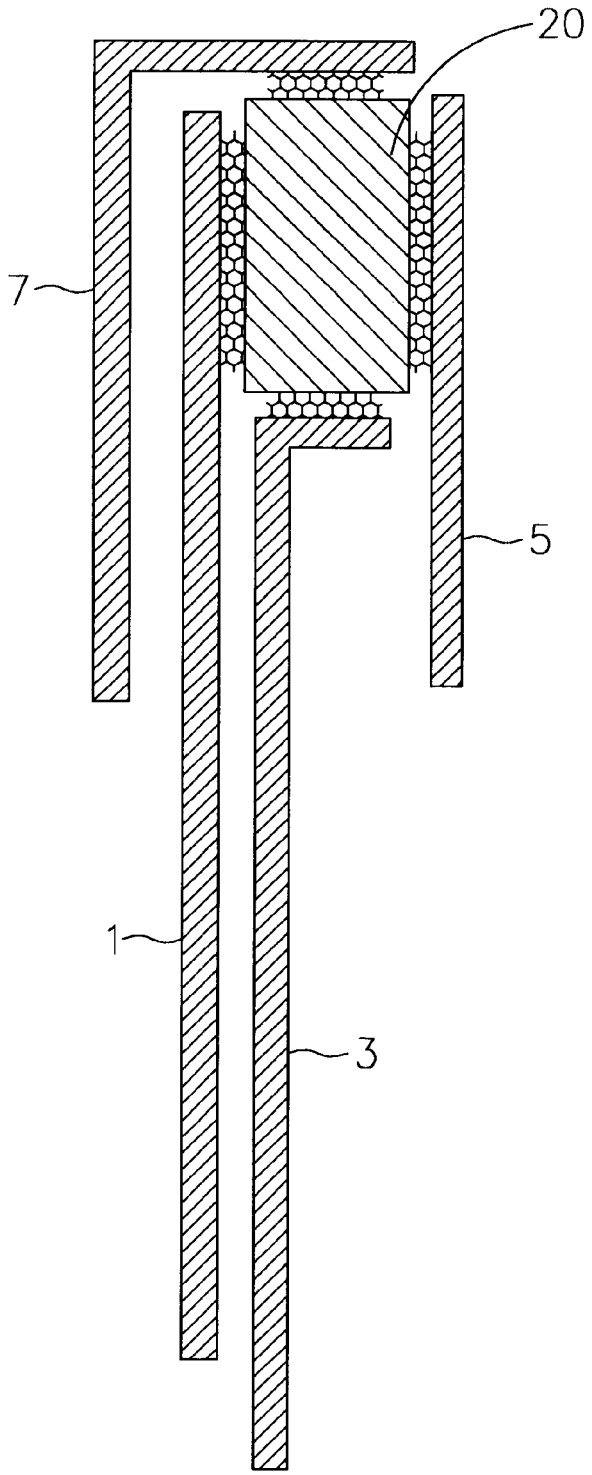
FIG. 4 is a cross-sectional view of the window treatment implementation of FIG. 1.

Referring now to FIG. 4, which is a cross sectional view looking to the left of the FIG. 1 embodiment, the left gingerbread panel 1 is attached to the front surface of a support bar 20 the left lace panel 3 is attached to the bottom surface of the support bar, the left small rick rack 5 is attached to the back surface of the support bar, and the center large rick rack panel 7 is attached on the top surface of the support bar. The rosette 9 is omitted for clarity.

Figure 5:
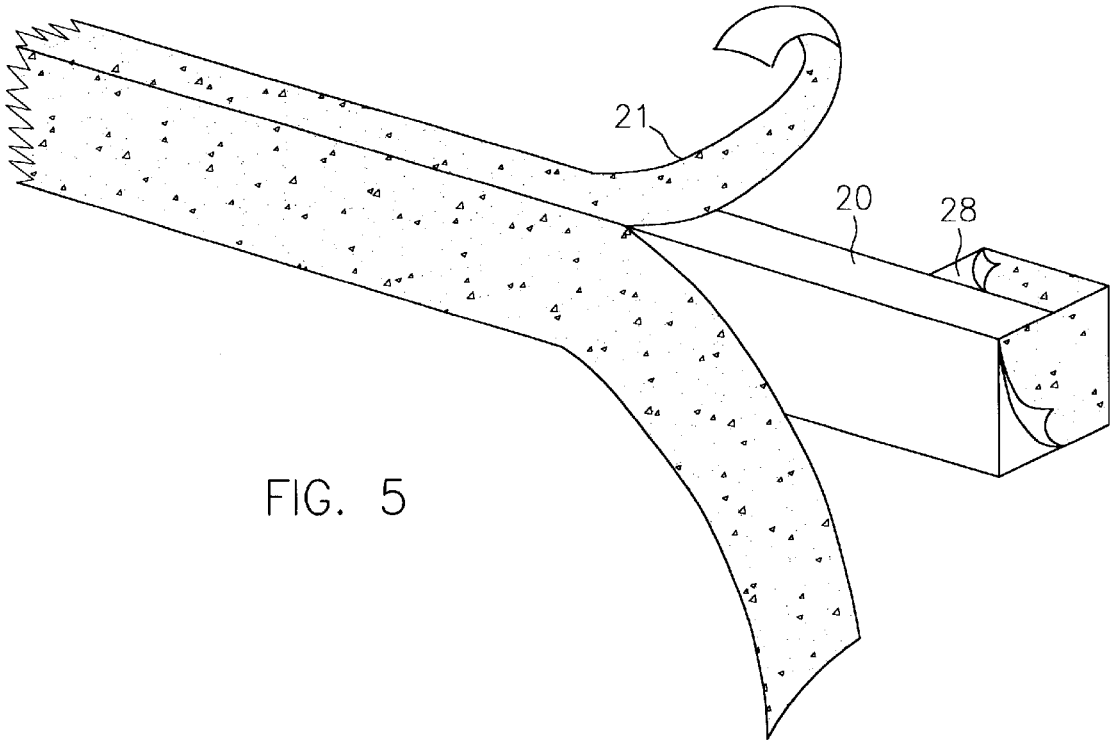
FIG. 5 is a front perspective view of the support means with hook and loop attachment surfaces.

Referring now to FIG. 5, the support bar 20, which is shown as an alternative solid bar, is preferably substantially covered with the hook portion of a strong hook and loop attachment means 21 such as a pressure sensitive hook and loop fabric material sold at craft stores. The support bar could be covered with the loop portion of the hook and loop attachment means, however, that would require the window treatment panels to have the hook portion of the attachment means, thereby increasing the likelihood of snagging of window panels during handling. In practice, placing the hook portion on the support bar has provided a stronger bond than placing the loop portion on the support bar.

Figure 6:
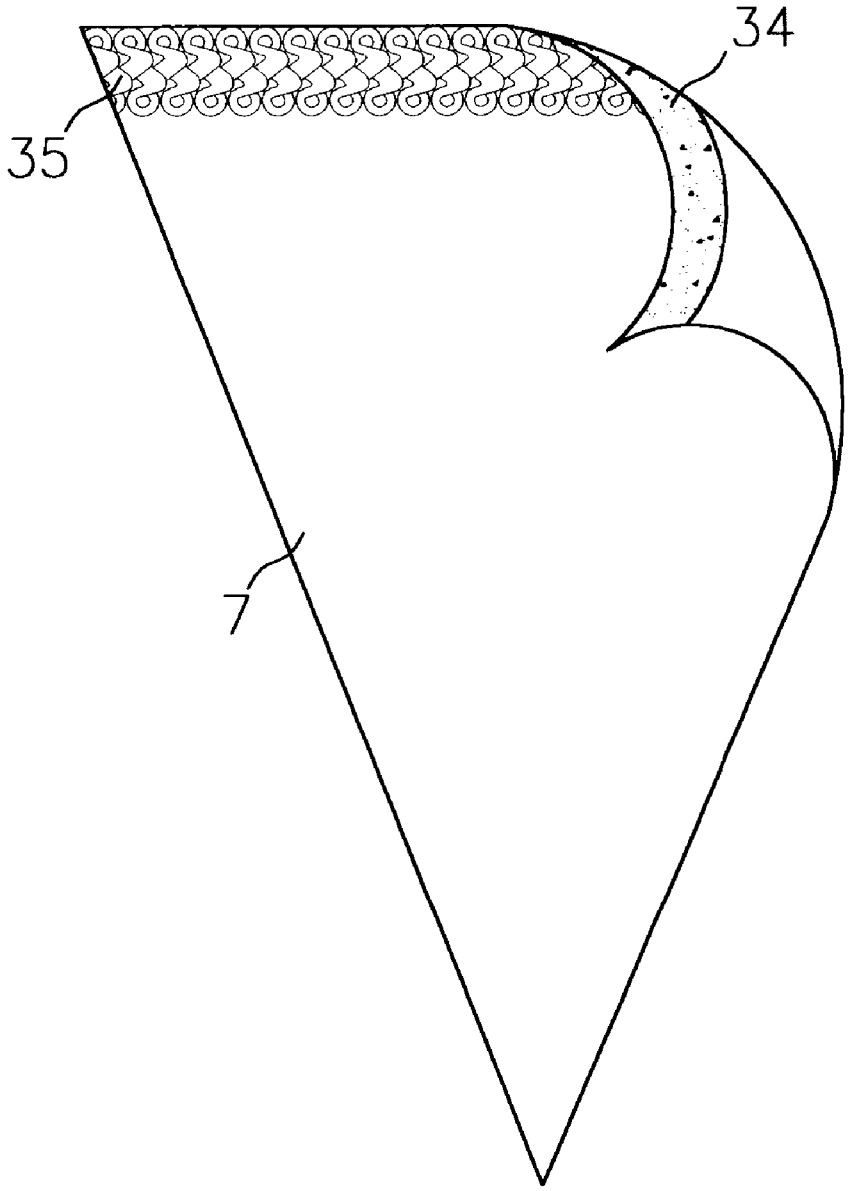
FIG. 6 is a view of the preferred fabric attachment means.

Referring now to FIG. 6, the preferred method of securing the window treatment panels is to attach a strip of the loop portion of a hook and loop attachment means 34 to the panel 7. The strip may be placed on either the front or rear of the panel depending upon whether the panel is intended to be hung in front of other panels, such as on the front or top surface of the bar; or behind other panels, such as on the rear or bottom surfaces of the bar. The preferred strip thickness is 0.5 to 1.0 inches, and the strip is preferably attached by sewing the strip to the panel so that one edge of the strip is approximately ⅛ to ¼ inch from the edge of the panel. The opposite side of the panel is typically decorated with a strip of gimp 35 and sewn with thread the same color as the gimp in order to hide the stitching. Alternately, the hook and loop material may be applied with an adhesive or by other fastening means.

This particular window treatment is only one of a large number of possible treatments which may be accomplished though the use of the removable panels in the bar with the hook and/or loop attachment means. Each of the panels described in this embodiment can vary according to color, size, texture, shape, pattern, and theme. One important aspect of this embodiment is the construction of an elaborate treatment from relatively simple window treatment panels using a versatile support bar with a temporary attachment means.

Alternate Embodiment—Supports

Referring now to FIG. 7, there are many geometric support embodiments of the current invention of substantially covering each surface of the support with a temporary attachment means.

Figure 7A:
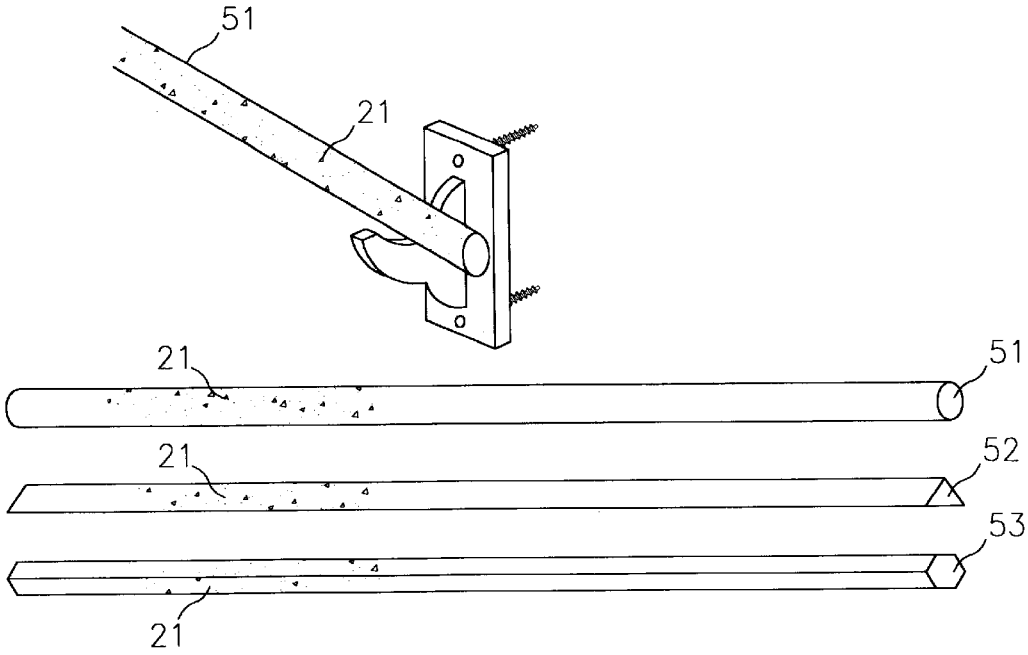
FIGS. 7A–7K are front perspective views of various support means.

FIG. 7A illustrates a hook or loop covered 21 support means with a round cross-section 51, a triangular cross-section 52, and a hexagonal cross-section 53. Although the rectangular cross section is generally preferred, the support means can be provided in a variety of geometric cross-sections.

Figure 7B:
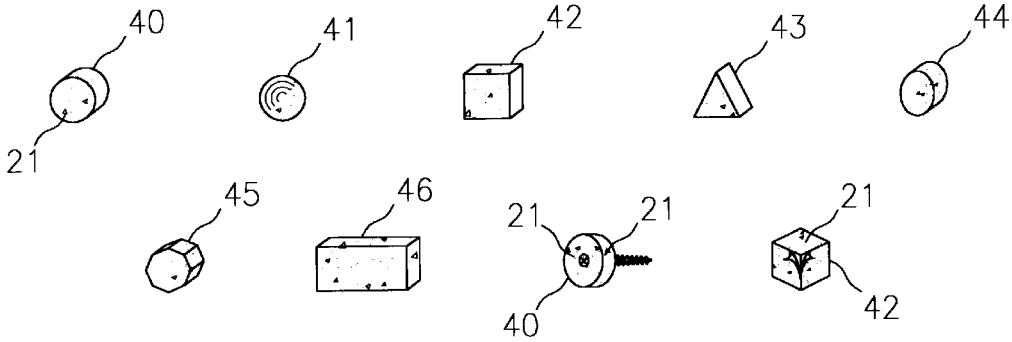

FIG. 7B illustrates a hook or loop covered 21 support peg means in a variety of cross-sections including round 40, spherical 41, square 42, triangular 43, ovular 44, octagonal 45, and rectangular 46.

Figure 7C:
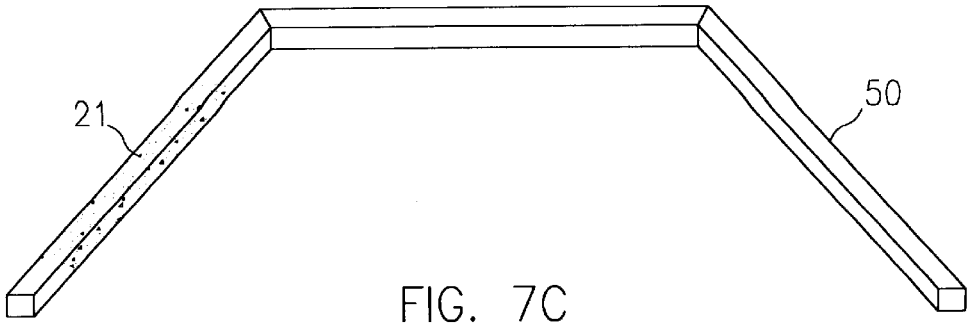

FIG. 7C illustrates a hook or loop covered 21 bayed rod 50.

Figure 7D:
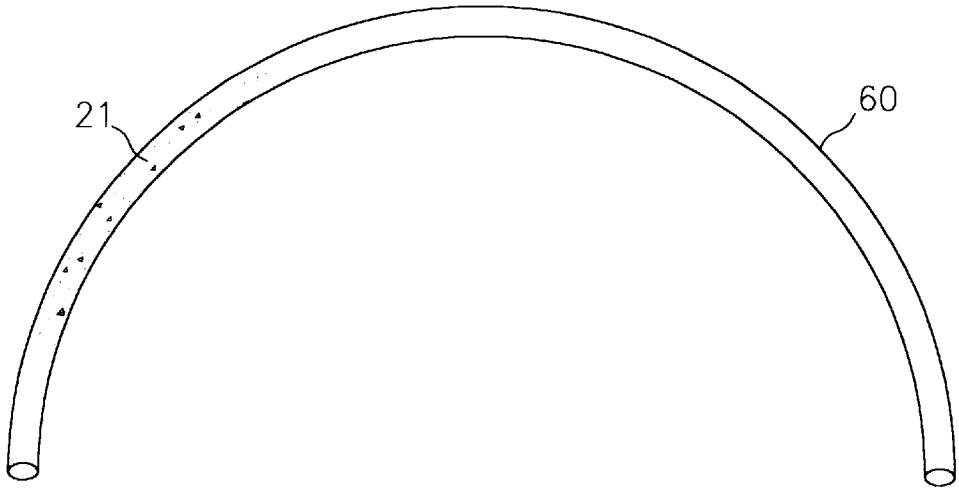

FIG. 7D illustrates a hook or loop covered 21 arched stationary or flexible rod 60.

Figure 7E:
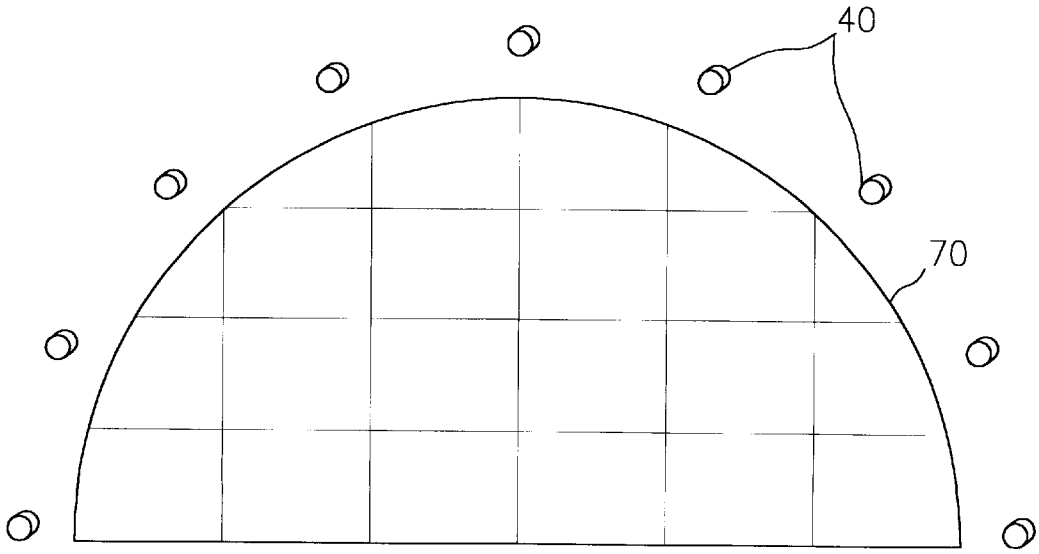

FIG. 7E illustrates a plurality of hook or loop covered 21 round support pegs 40 around the top of a bayed window 70. One or more window panels may be draped from those support pegs to create a window treatment for the bayed window.

Figure 7F:
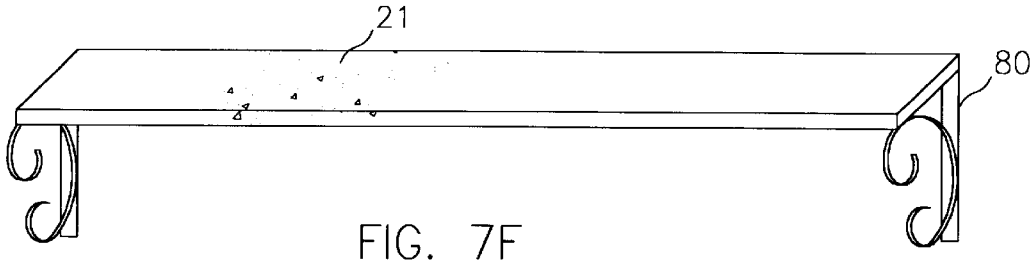

FIG. 7F illustrates a hook or loop covered 21 support means with a shelf cornice 80.

Figure 7G:
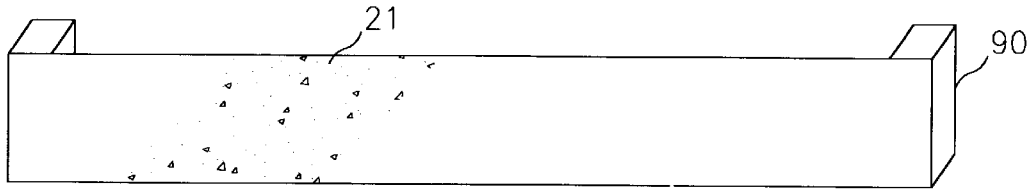

FIG. 7G illustrates a hook or loop covered 21 support means with a flat cornice 90.

Figure 7H:
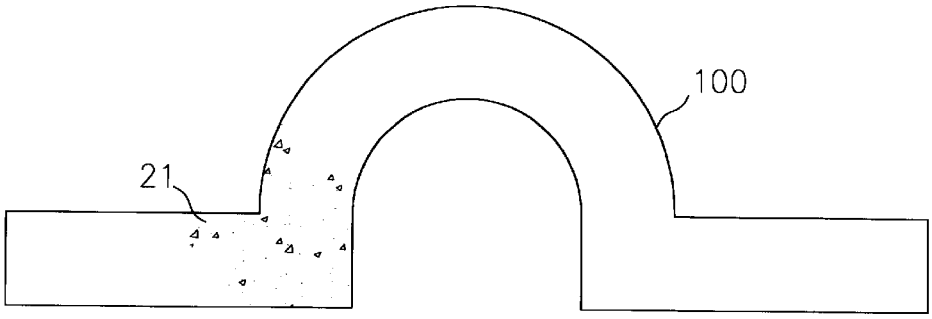

FIG. 7H illustrates a hook or loop covered 21 support means with a captain's hat cornice 100.

Figure 7I:
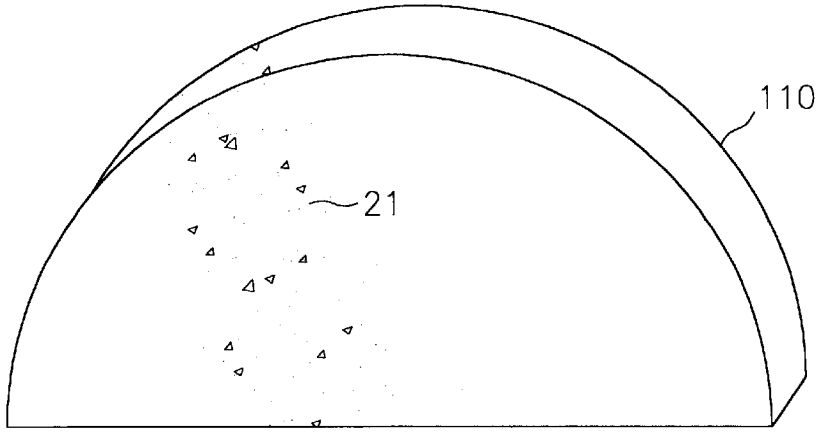

FIG. 7I illustrates a hook or loop covered 21 support means with an arched cornice board 110.

Figure 7J:
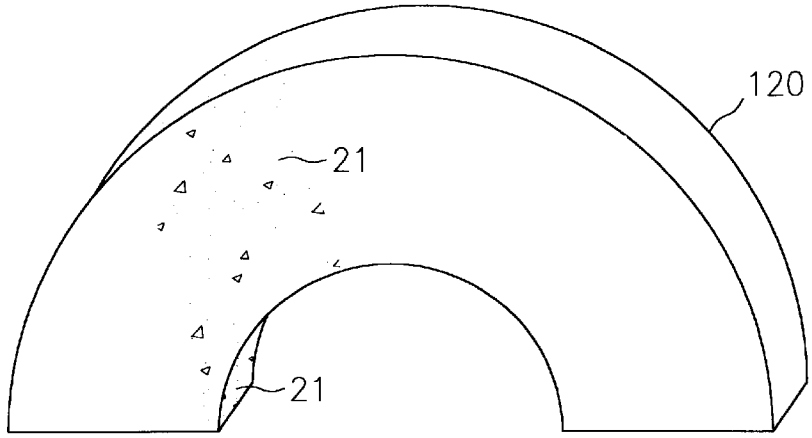

FIG. 7J illustrates a hook or loop covered 21 support means with a horse shoe cornice board 120.

Figure 7K:
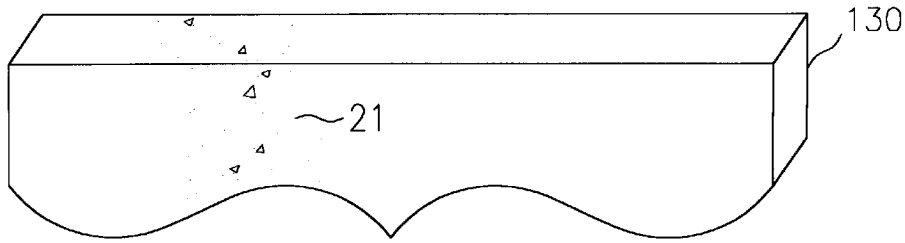
Figure 8A:
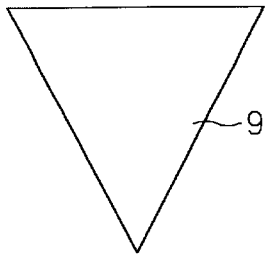
FIGS. 8A–8K are front view of various styles and designs of valances.
Figure 8B:
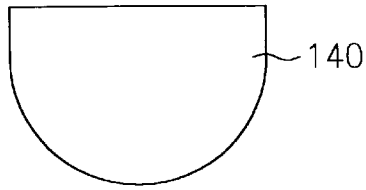
Figure 8C:
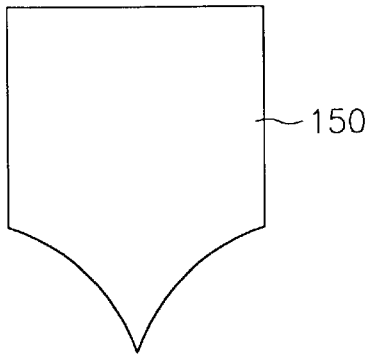
Figure 8D:
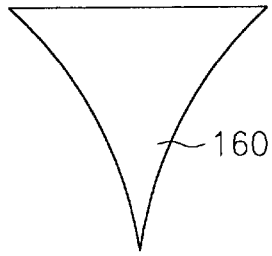
Figure 8E:
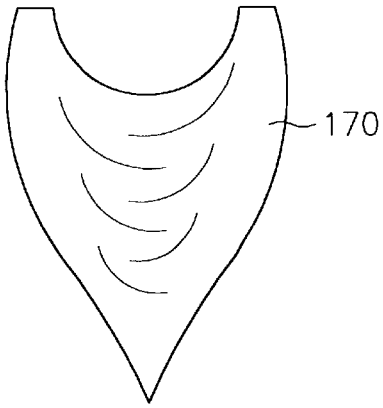
Figure 8F:
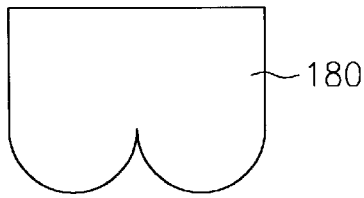
Figure 8G:
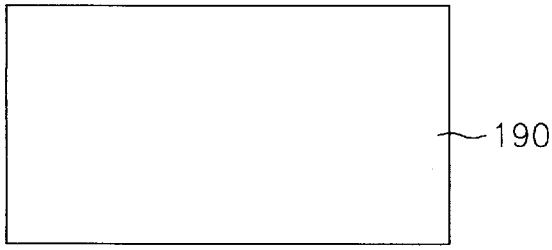
Figure 8H:
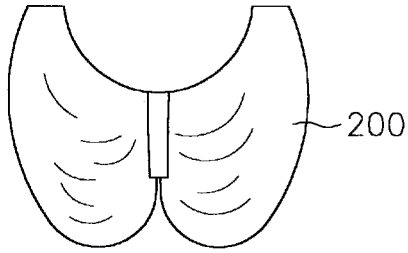
Figure 8I:
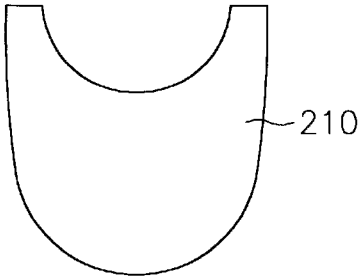
Figure 8J:
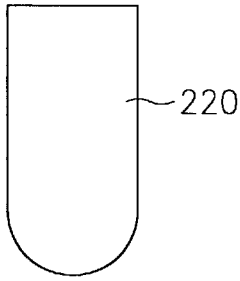
Figure 8K:
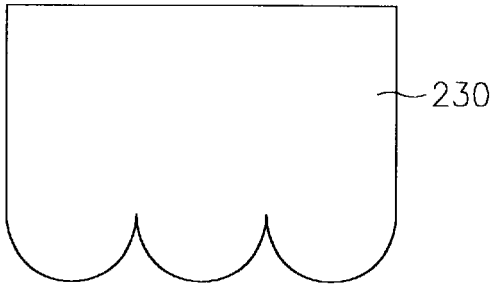

FIG. 7K illustrates a hook or loop covered 21 support means with a cornice board of a general shape 130.

Alternate Embodiment—Valances

Referring now to FIG. 8, various styles and designs of valances are illustrated. A valance is a short window treatment. One or more valance may be used between two side panels. These valances would typically have the loop portion of a hook and loop attachment means near the top edge, on either the front or rear of the valance. FIG. 8A shows a rick rack 9. FIG. 8B shows a sunrise 140. FIG. 8C shows a prism 150. FIG. 8D shows a cone 160. FIG. 8E shows a bib 170. FIG. 8F shows a dovetail 180. FIG. 8G shows a brick 190. FIG. 8H shows a collar 200. FIG. 8I shows a pocket 210. FIG. 8J shows a sincle scallop 220. FIG. 8K shows a triple scallop 230. An object of the present invention is to permit the valances to be interchangeable to permit easy substitution of valance shapes, patterns, or colors.

Alternate Embodiment—Swags

Figure 9A:
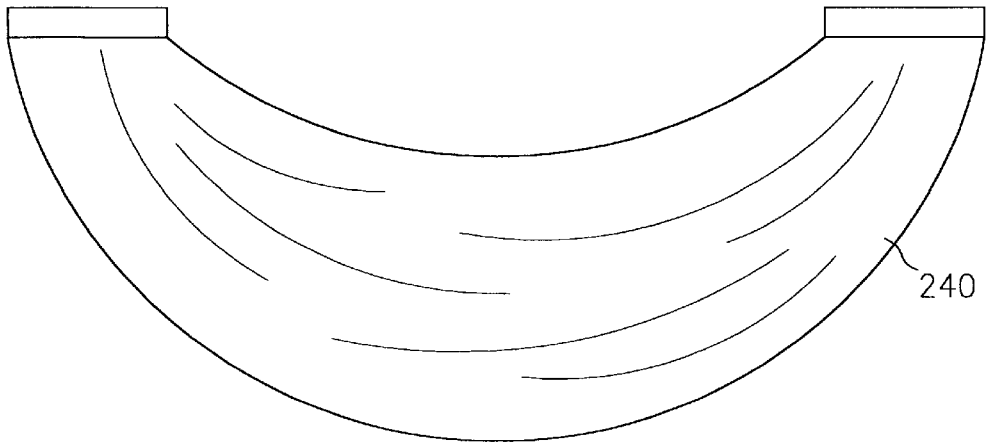
FIG. 9A is a front view of a veil swag.
Figure 9B:
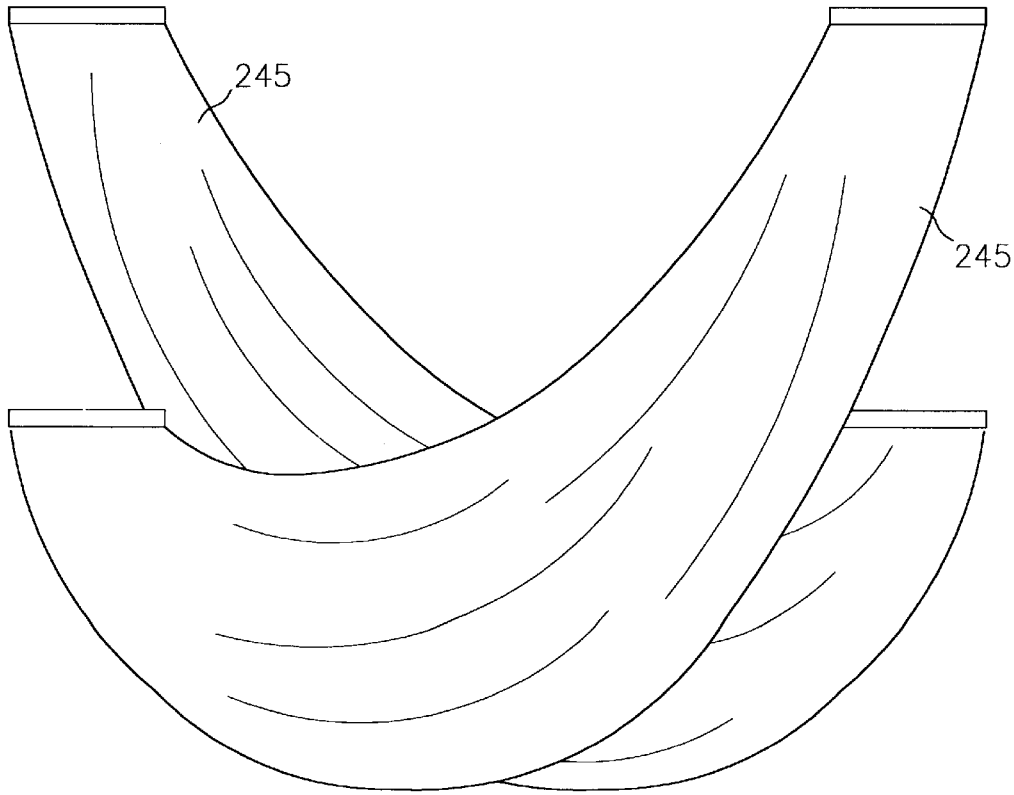
FIG. 9B is a front view of a tapered veil swag.
Figure 10A:
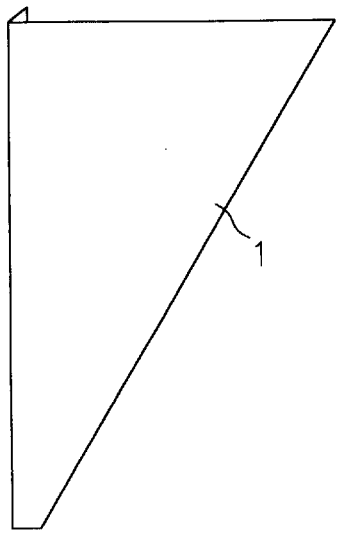
FIGS. 10A–10K are front views of various styles and designs of side panels.
Figure 10B:
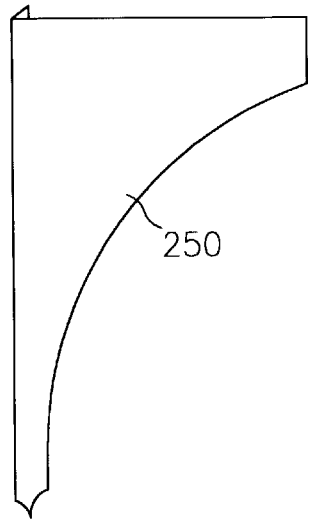
Figure 10C:
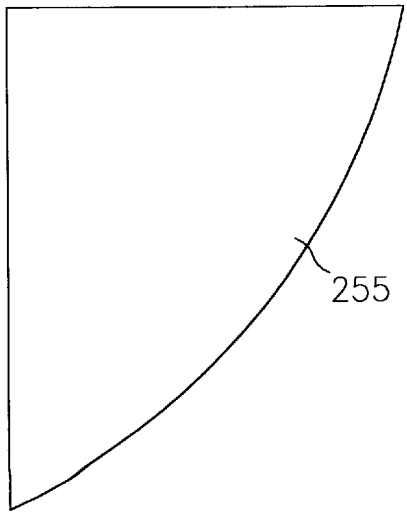
Figure 10D:
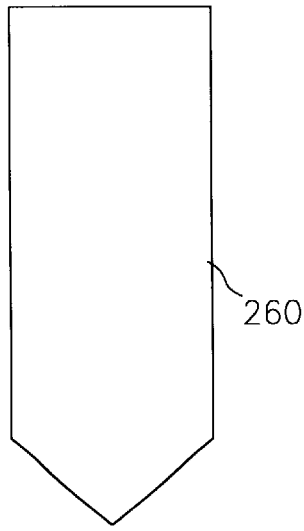
Figure 10E:
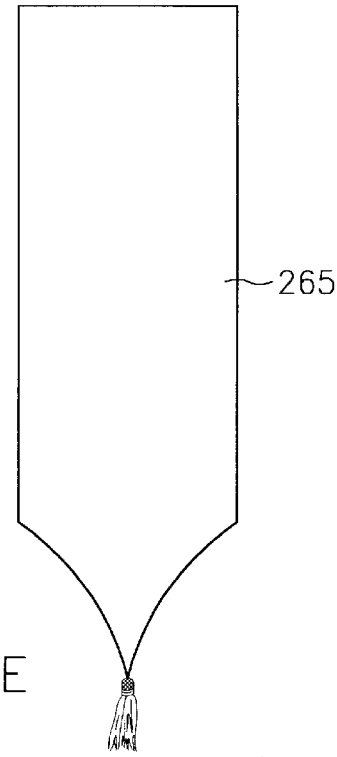
Figure 10F:
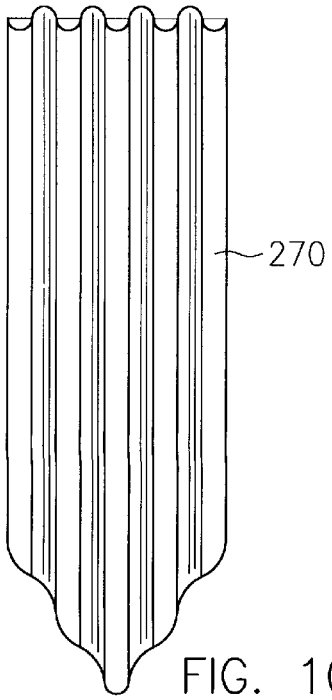
Figure 10G:
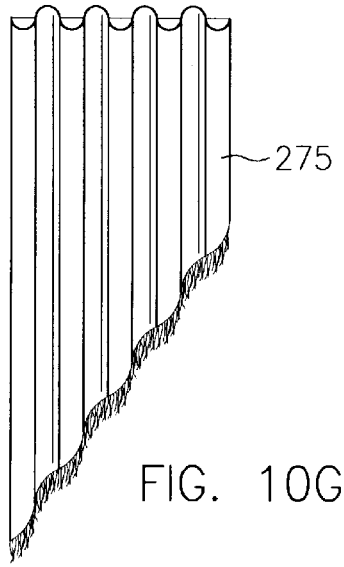
Figure 10H:
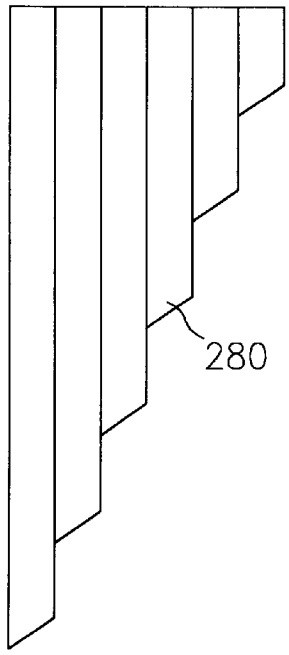
Figure 10I:
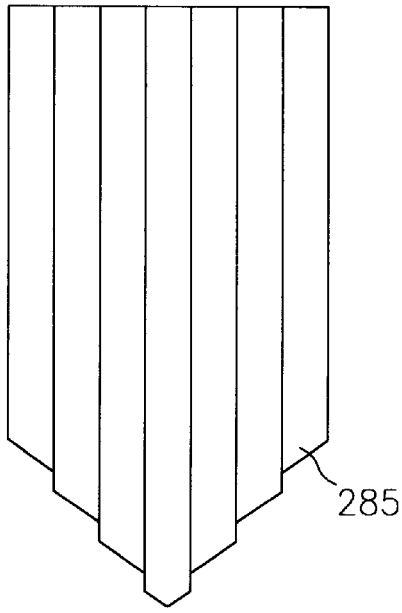
Figure 10J:
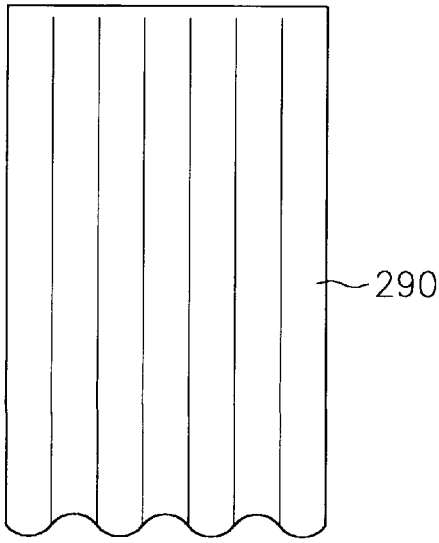
Figure 10K:
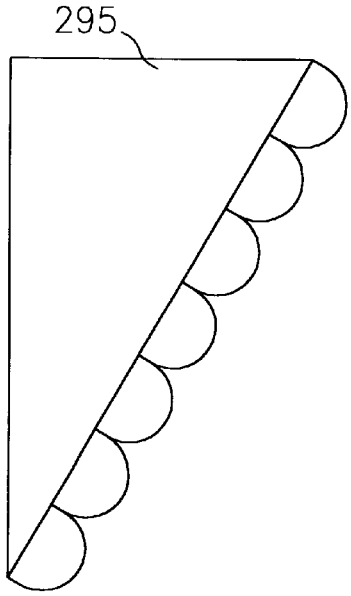
Figure 11A:
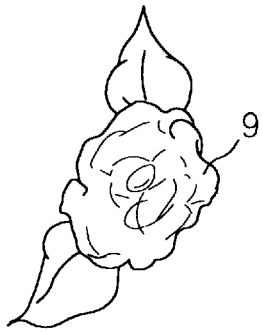
FIGS. 11A–11J are front views of various window treatment accessories.
Figure 11B:
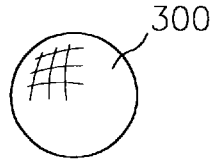
Figure 11C:
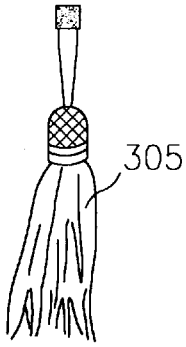
Figure 11D:
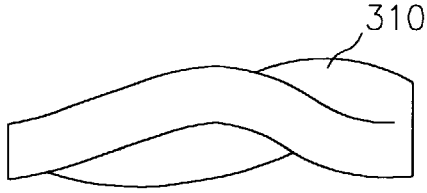
Figure 11E:
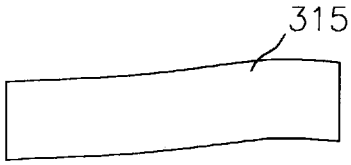
Figure 11F:
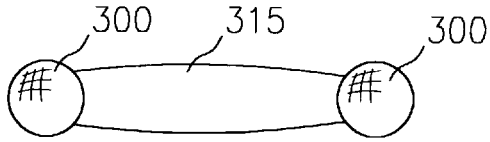
Figure 11G:
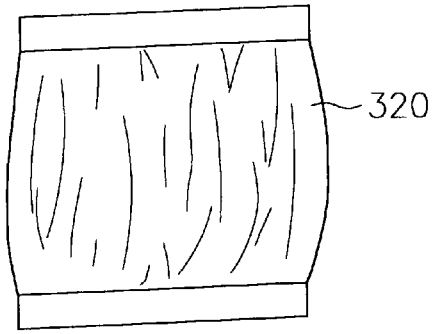
Figure 11H:
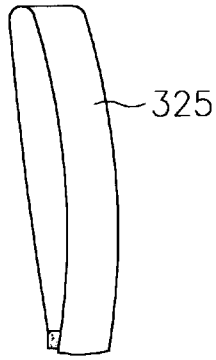
Figure 11I:
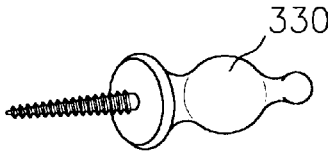
Figure 11J:
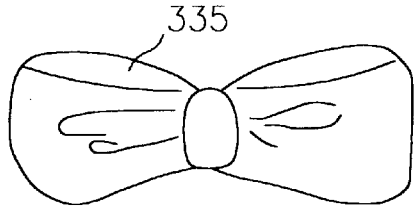

Referring now to FIG. 9, various styles and designs of swags are illustrated. A swag is a window treatment which is curved between its ends. FIG. 9A illustrates a veil swag 240 where both ends attach to a support means. FIG. 9B illustrates two tapered veils 245 where the upper ends would typically attach to a support bar means and the lower ends would typically attach to support pegs. An object of the present invention is to permit the swags to be interchangeable and to permit easy substitution of swags for panels and valances.

Alternate Embodiment—Side Panels

Referring now to FIG. 10, various styles and designs of side panels are illustrated. These side panels typically have a loop attachment strip on the top front or rear edge. Some panels are shown as left panels, and have a corresponding right panel. FIG. 10A shows a left gingerbread panel 1. FIG. 10B shows a left stained glass side panel 250. FIG. 10C shows a left pie angle side panel 255. FIG. 10D shows a chandelier side panel 260 which, like many of the panels, could be used either on the right or the left side of the window. FIG. 10E shows a runner side panel 265. FIG. 10F shows a gathered runner side panel 270. Any of the panels may be gathered in this manner. FIG. 10G shows a gathered gingerbread side panel 275. FIG. 10H shows a left pleated jabot side panel 280. FIG. 10I shows a pleated chandelier 285. FIG. 10J shows a traditional gathered panel 290. FIG. 10K shows a left scalloped gingerbread 295. An object of the present invention is to permit the panels to be interchangeable to permit easy substitution of panel shapes, patterns, or colors.

Alternate Embodiment—Accessories

Referring now to FIG. 11, various styles and designs of accessories are illustrated. Most of these accessories may be attached to the support means or separate support pegs. FIG. 11A is a fabric rosette 9 which has a hook and loop attachment means on its rear surface. FIG. 11B is a button 300 which has a hook and loop attachment means on its rear surface. FIG. 11C is a tassel 305 which has a hook and loop attachment means on its top rear surface. FIG. 11D is a twisted strap 310 which has a hook and loop attachment means on its right and left edges. FIG. 11E is a straight strap 315 which has a hook and loop attachment means on its right and left edges. FIG. 11F is a straight strap 315, with a button 300 on its right and left. FIG. 11G is a gathered rod cover 320 which may vary in length and which has a hook and loop attachment means on its upper and lower edges. FIG. 11H is a tie back strap 325 which has a hook and loop attachment means on its rear surface. FIG. 11I is a screw-in finial 330, which is used to cover the ends of any of the rods. FIG. 11J is a bow 335 which has a hook and loop attachment means on its rear or bottom surface. An object of the present invention is to permit the accessories to be easily interchangeable.

Alternate Embodiment—Window Treatment

Figure 12:
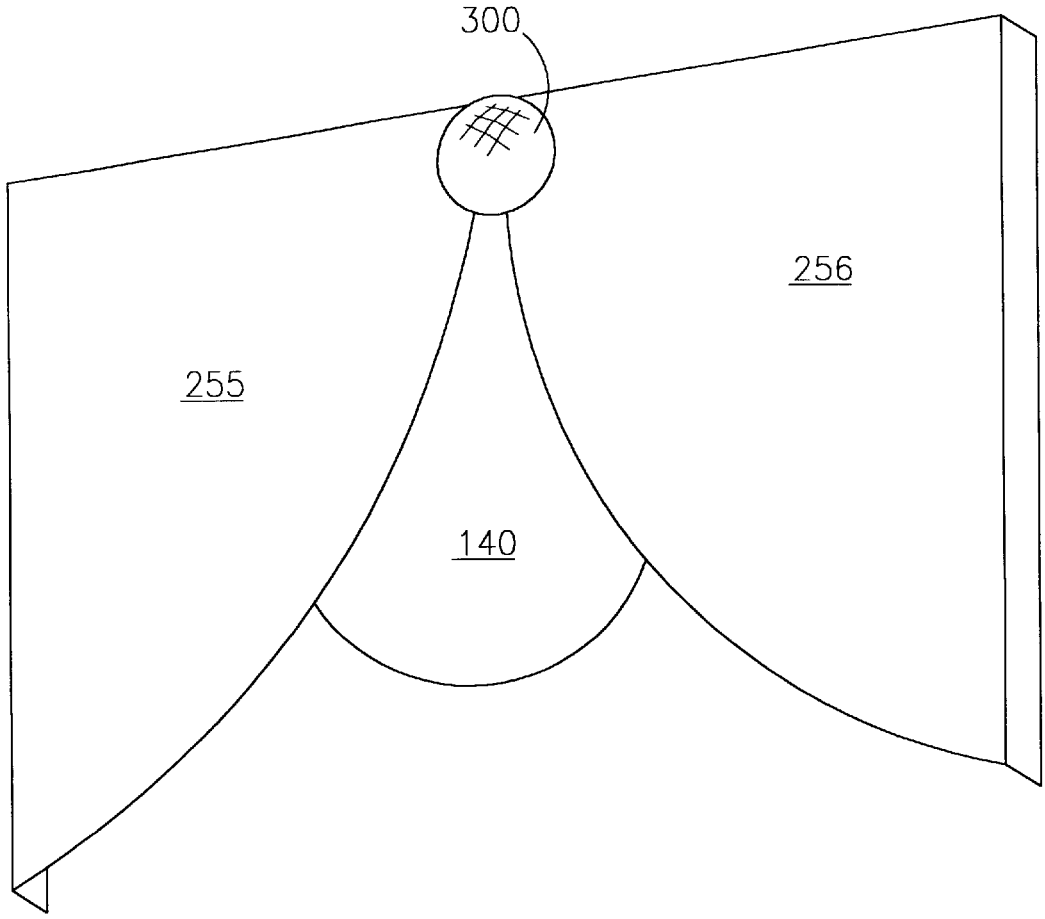
FIG. 12 is a perspective view of an alternate window treatment.

Referring now to FIG. 12, another window treatment with multiple window treatment panels with decorations is illustrated. This window treatment is accomplished with a rectangular support bar means having a hook and loop attachment means on at least its front and rear surfaces. The window panels include a left pieangle panel 255 which is attached to the front of the support bar means and which is also attached to the left edge of the support bar means. The pie angle makes a right angle with respect to the window and the wall. A similar right pieangle 256 is attached to the front of the support bar means and to the right edge of the support bar means. A sunrise panel 140 is centered between the two pieangle panels and attached on the rear of the support bar means. A button 300 is attached to the center front of the support bar means between the two pieangles.

Alternate Embodiment—Window Treatment

Figure 13:
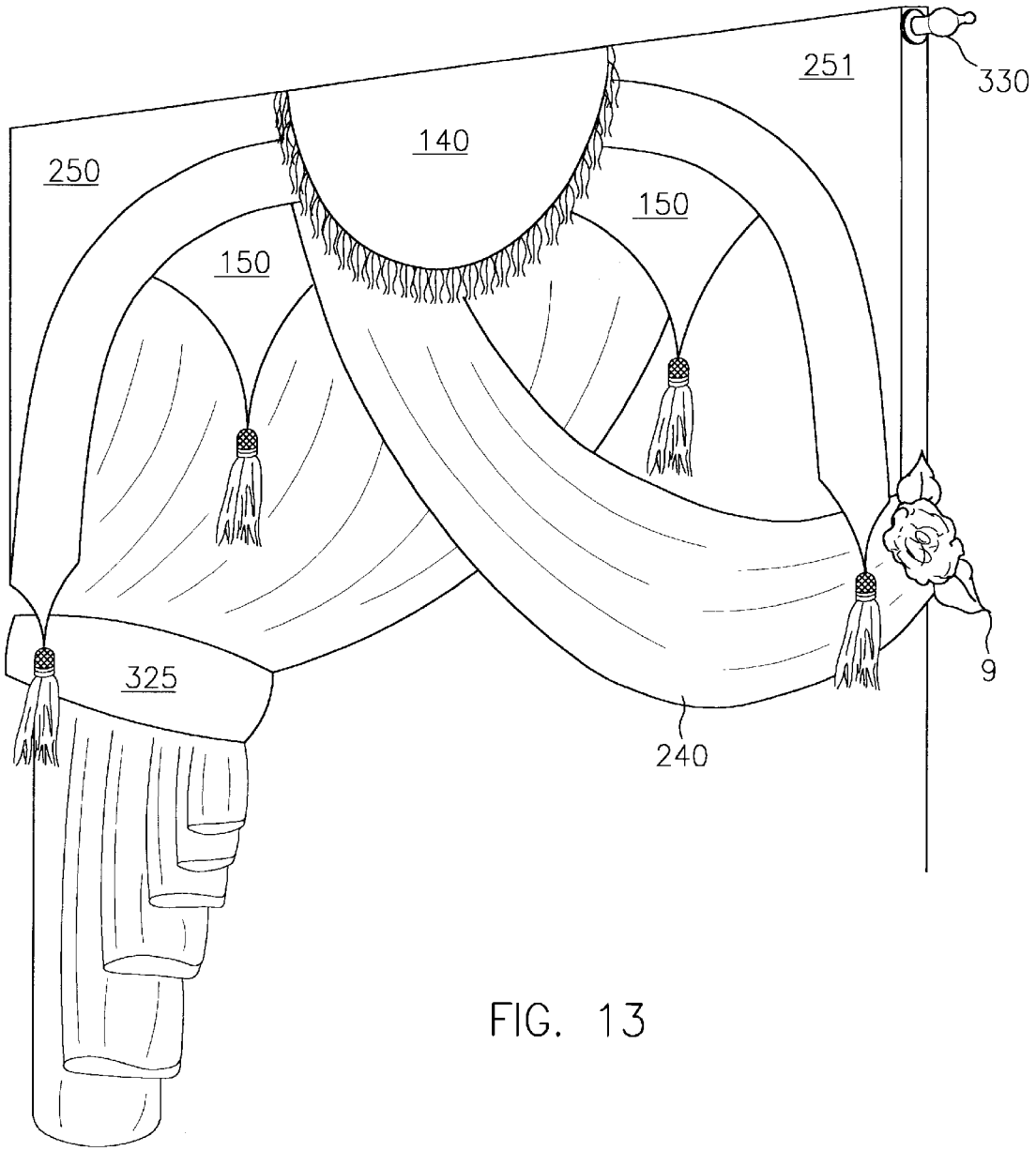
FIG. 13 is a perspective view of an alternate window treatment.

Referring now to FIG. 13, another window treatment with multiple window treatment panels with decorations is illustrated. This window treatment is accomplished with a rectangular support bar means having a hook and loop attachment means on all four surfaces. A screw in finial 330 is shown attached to the right side of the support bar for decoration. The window panels include a left stained glass panel 250 which is attached to the front of the support bar and also attached to the left edge of the bar. The stained glass panel makes a right angle with respect to the window and the wall. A similar right stained glass panel 251 is attached to the front of the rod into the right edge of the rod. A sunrise panel 140 is attached in the center on top of the rod. Directly to the right and left of the sunrise, prisms 150 are attached to the underneath of the rod. A veil swag 240 is attached underneath the support bar at the left upper edge. The lower edge of the veil swag is attached to a round support peg 40 which is attached to the inside of the window at the lower edge of the right stained glass panel. A rosette 9, cover the support peg. A wide panel 340 which is approximately the same width as the rod is attached to the rear of the rod and a tie back strap 325 is attached to another round support peg to hold the wide panel to the left side of the window at the lower edge of the right stained glass panel.

Alternate Embodiment—Window Treatment

Figure 14:
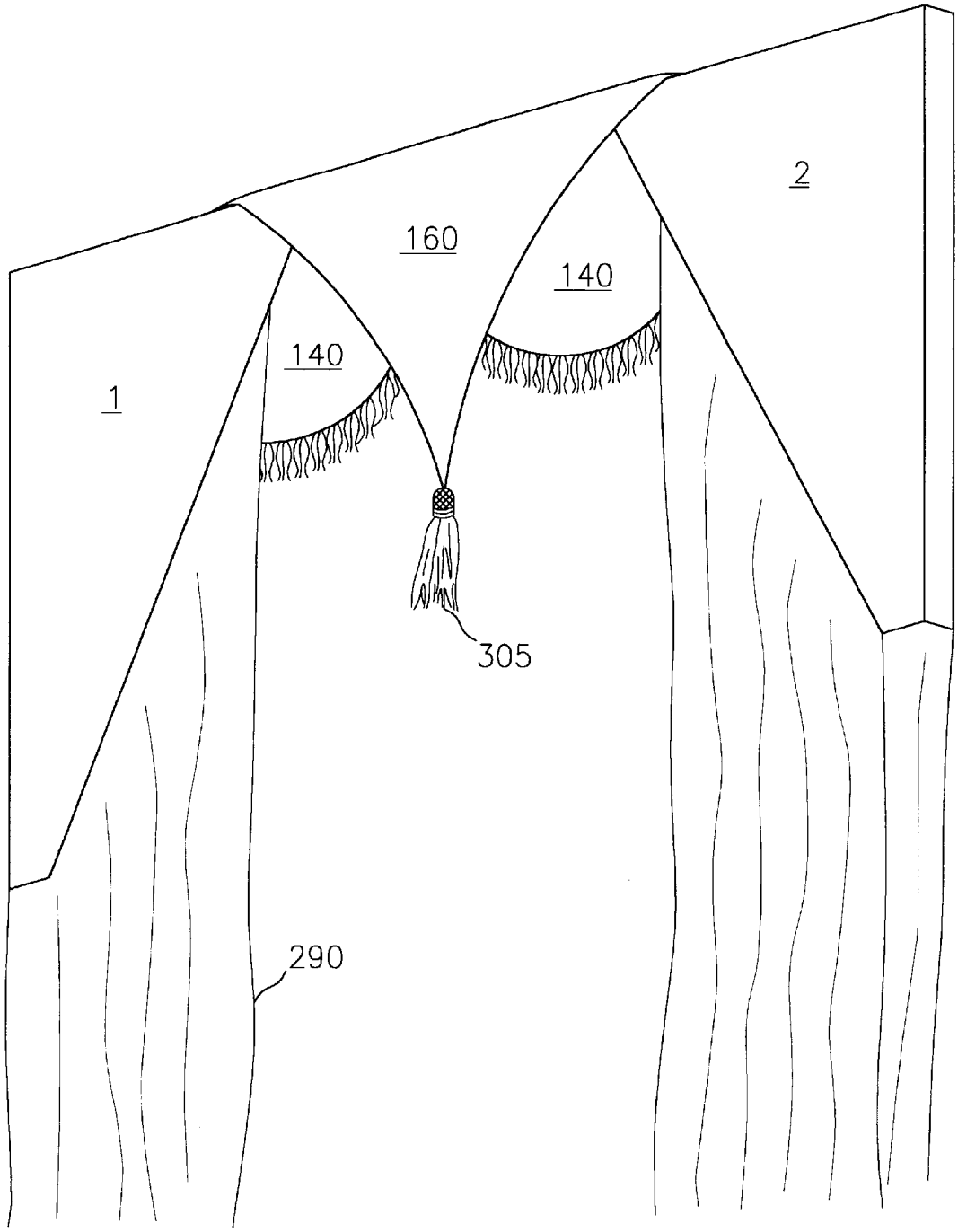
FIG. 14 is a perspective view of an alternate window treatment.

Referring now to FIG. 14, another window treatment with multiple window treatment panels with decorations is illustrated. This window treatment is accomplished with a rectangular support bar means having a hook and loop attachment means on at least three surfaces. The window panels include a left gingerbread panel 1 which is attached to the front of the support means and is also attached to the left edge of the support means. The stained glass panel makes a right angle with respect to the window and the wall. A similar right gingerbread panel 2 is attached to the front of the rod into the right edge of the rod. A cone 160 is attached near the center on the top of the support bar. A tassel 305 is attached to the lower edge of the cone. A sunrise 140 is attached to the rear of the support means centered between the cone and the right gingerbread panel. A similar sunrise 140 is attached to the rear of the support centered between the cone and the left gingerbread panel. A traditional gathered panel 290 is attached underneath the rod behind the left gingerbread panel and extends several feet lower on the window than the gingerbread panel. A similar traditional gathered panel 290 is attached underneath the rod behind the right gingerbread panel.

Alternate Embodiment—Window Treatment

Figure 15:
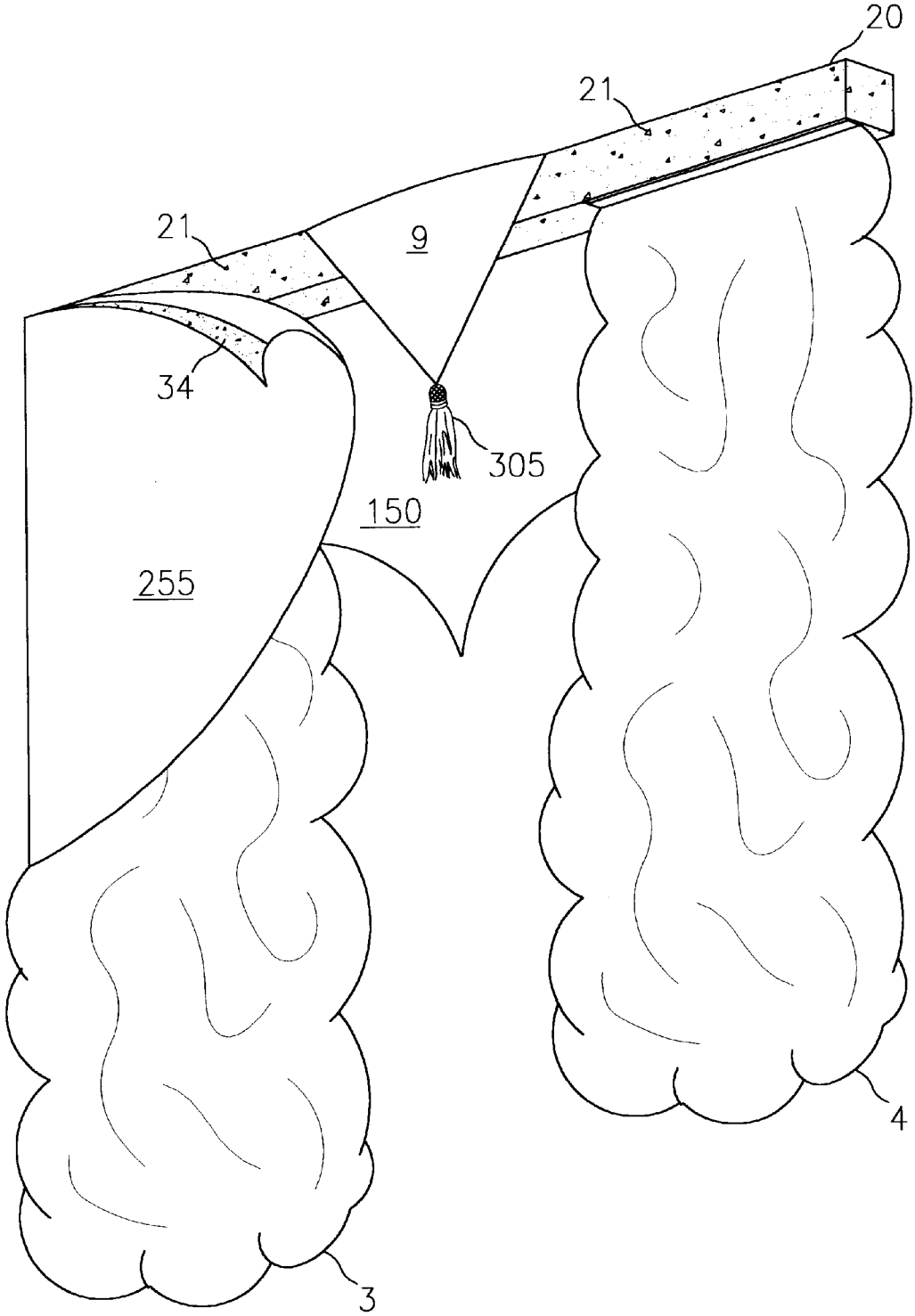
FIG. 15 is a cutaway view of an alternate window treatment.
Figure 16A:
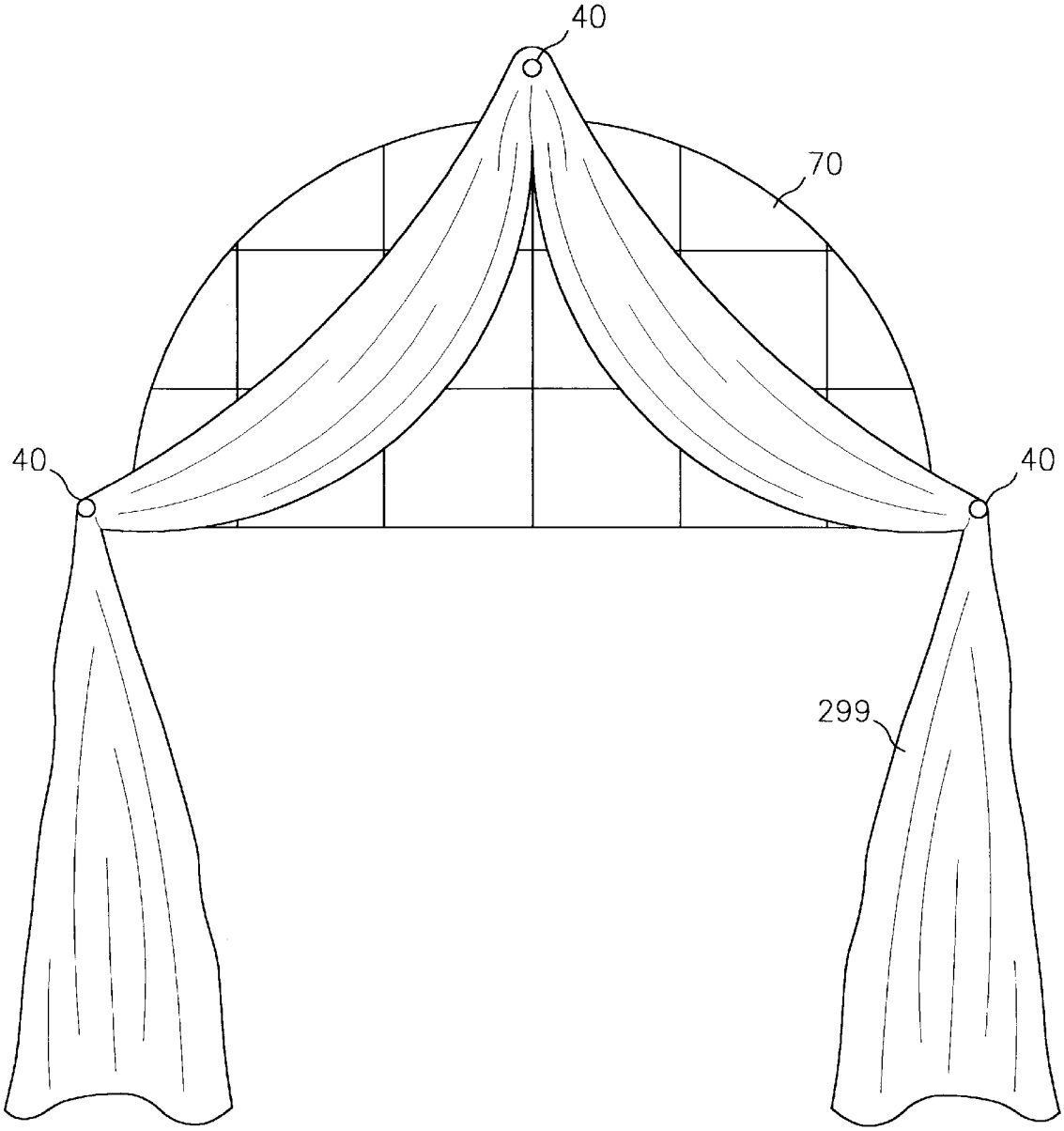
FIG. 16A is a front view of a window treatment for an arched window.
Figure 16B:
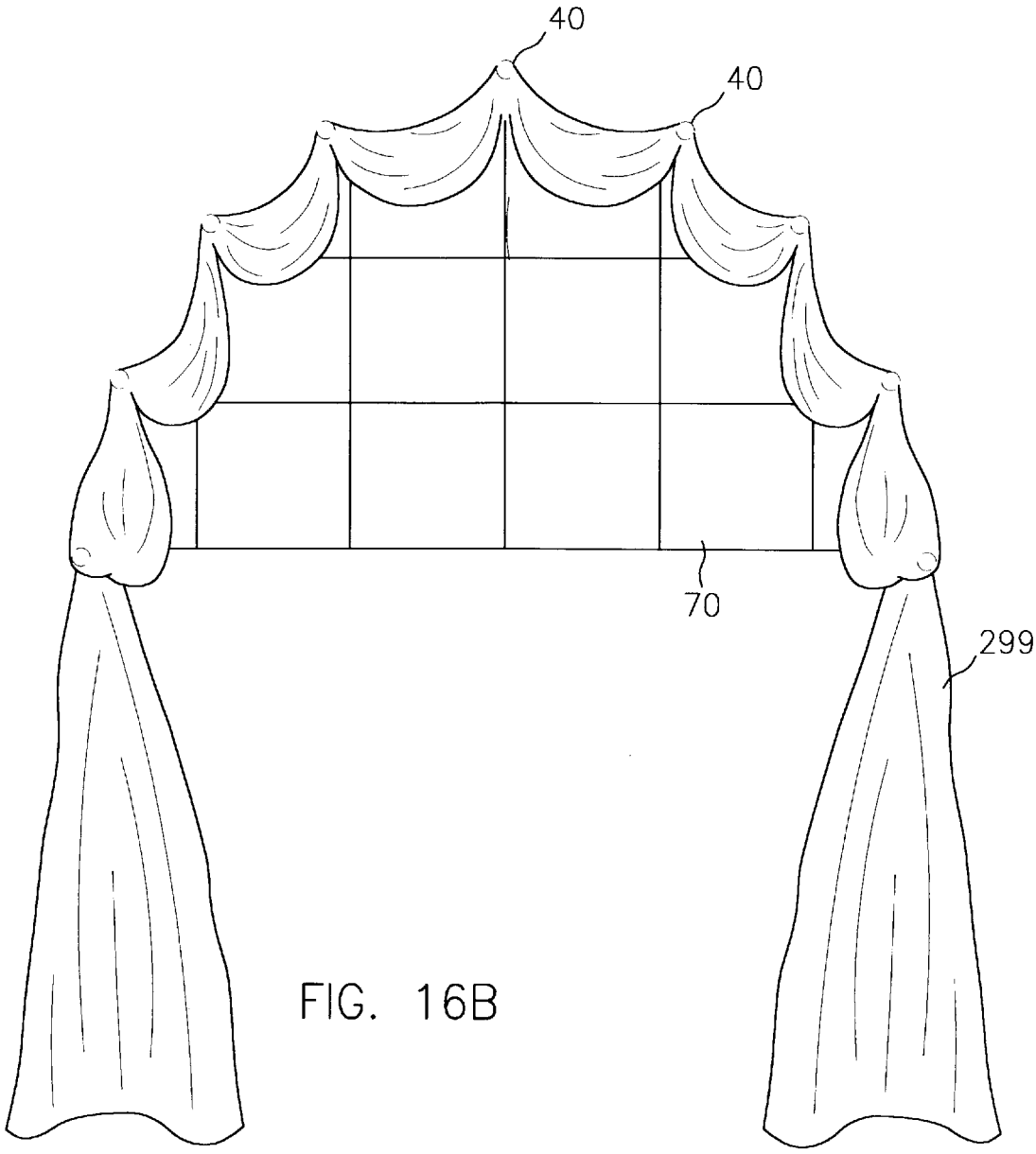
FIG. 16B is a front view of a window treatment for an arched window.
Figure 16C:
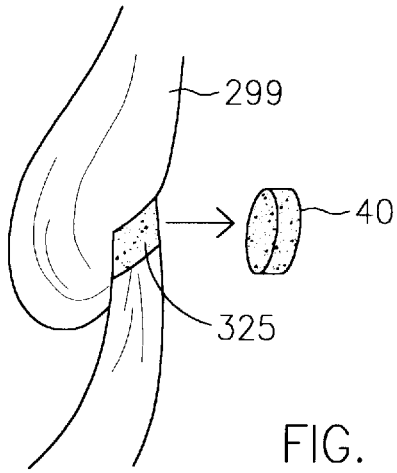
FIG. 16C is a detailed view of fabric attachment for an arched window.

Referring now to FIG. 15, another window treatment with multiple window treatment panels with decorations is illustrated. This window treatment is accomplished with a rectangular support bar means having a hook and loop attachment means on at least three surfaces, as illustrated in the cutaway view. The support means is a rectangular support bar 20 having a hook and loop attachment means 21 on all surfaces. Alternative cross section rods and adjustable telescoping extension rods may also be used.

The window panels include a left pie angle panel 255 which is attached to the front of the squared rectangular support bar means with a strip of hook and loop attachment means 34. The panel is also attached to the left edge of the bar. The pie angle panel makes a right angle with respect to the window and the wall. A rick rack 9 is attached in the center on top of the bar. A tassel 305 is attached to the lower edge of the rick rack. A prism 150 is attached to the rear of the bar centered behind the rick rack. A lace panel 3 is attached underneath the bar behind the left pie angle panel and extends several feet lower on the window than the pie angle panel. A similar lace panel 4 is attached on the right side.

Alternate Embodiment—Interchangeable Window Treatment

Referring now to FIG. 17, an example of substituting window treatment panels is shown. Each of the previous window treatment embodiments may have panels interchanged in a similar manner.

Figure 17A:
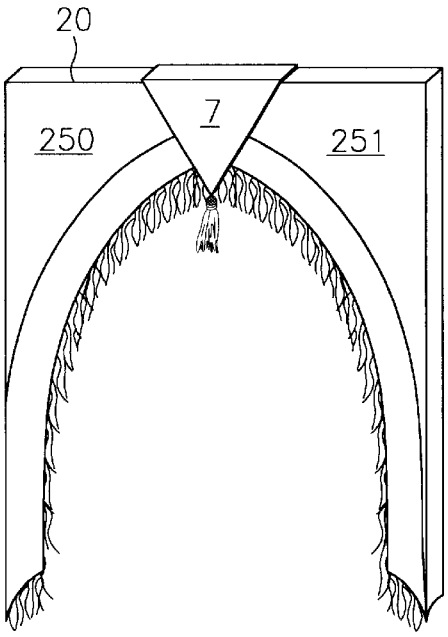
FIGS. 17A–17D are front perspective views of a window treatment illustrating panel substitution.

FIG. 17A shows the window treatment with a left stained glass panel 250 which is attached to the front of the support bar 20. A similar right stained glass panel 251 is attached to the front of the bar on the right side. A center large rick rack panel 7 is attached on the top of the bar. A tassel 305 is attached to the bottom of the rick rack.

Figure 17C:
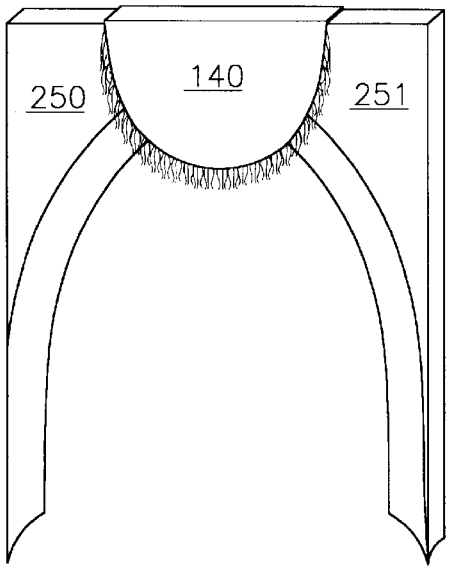
Figure 17B:
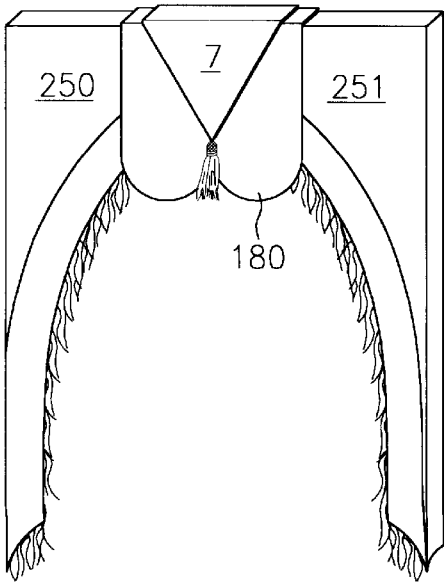

FIG. 17B shows the window treatment modified by removing the rick rack panel, attaching a center dovetail panel 180 on the top of the bar, and then attaching the rick rack panel 7 to the rear of the bar and folding the rick rack panel over the top of the bar.

FIG. 17C shows the window treatment modified by substituting new stained glass panels 250', 251', and attaching a center sunrise panel 140 to the top of the bar.

Figure 17D:
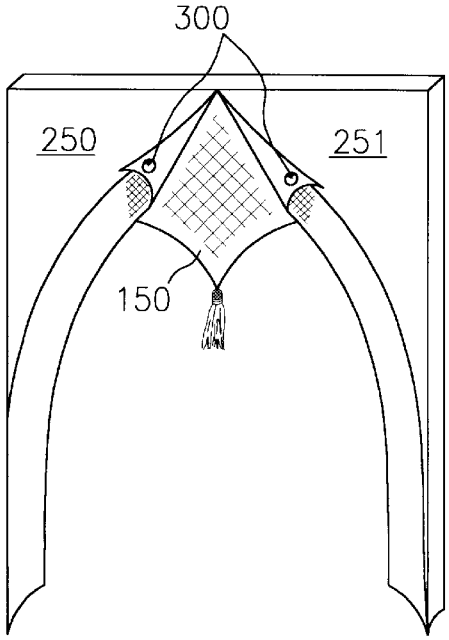

FIG. 17D shows the window treatment modified by removing the center sunrise panel and attaching a center prism panel 150 to the back of the bar. Buttons 300 are used to fold back the lower inside edge of the left and right stained glass panels.

Alternate Embodiment—Interior Window Support

The previous embodiments illustrate window treatments where the support bar means is mounted across a window. An alternative embodiment is to attach the support bar to the top inside window frame and to hang panels from that bar. The interior mounting method typically provides a front, a rear, and bottom surface to attach window treatment panels.

Alternate Embodiment—Wall Treatment

An alternative embodiment is to mount a support bar directly to a wall, and to create a wall treatment, such as a tapestry, rather than a window treatment.

Alternate Embodiment—Fixed Support Rod

Figure 18:
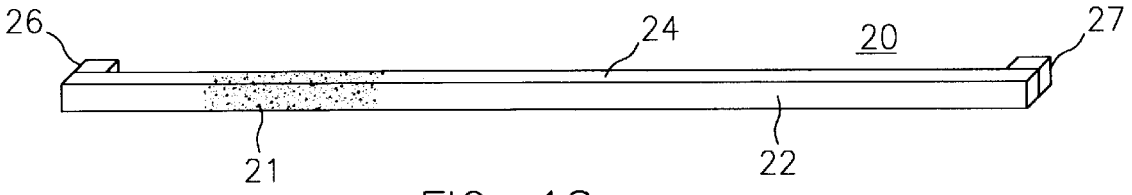
FIG. 18 is a perspective view of a rectangular support rod.

Referring now to FIG. 18, the window treatments may be accomplished with a single rectangular support bar 20 having the hook portion of a hook and loop attachment means 21 substantially covering all surfaces of the support bar. The support rod includes a front surface 22, a rear surface 23, a top surface 24, a bottom surface 25, a left end surface 26, and a right end surface 27. The preferred dimensions of the support bar for windows up to 3 feet in width is approximately 2 inches in height, 1 inch in depth, and a length that is generally about 2 to 3 inches wider than the window on each side of the window. The preferred material of construction is wood. Alternative materials include plastic, aluminum, or any material or composition that has sufficient strength to support the curtain panels.

What is claimed is:

1. A multiple panel window treatment comprising:

a support bar having a longitudinal axis and a generally polygonal cross section generally normal to said longitudinal axis, the support bar having at least first, second, and third surfaces disposed substantially parallel to said longitudinal axis and non-coplanar with respect to each other;

said first surface comprising a first portion of a hook and loop fastening means covering substantially all of said first surface for attachment thereto from a first direction;

said second surface comprising a first portion of a hook and loop fastening means covering substantially all of said second surface for attachment thereto from a second direction, said second direction different from said first direction;

said third surface comprising a first portion of a hook and loop fastening means covering substantially all of said third surface for attachment thereto from a third direction, said third direction different from both said first and second directions;

a first window treatment panel having at least one integral strip of the second portion of a hook and loop fastening means and removably attached to said first surface via said first portion of the hook and loop fastening means of said first surface;

a second window treatment panel having at least one integral strip of the second portion of a hook and loop fastening means and removably attached to said second surface via said first portion of the hook and loop fastening means of said second surface; and a third window treatment panel having at least one integral strip of the second portion of a hook and loop fastening means and removably attached to said third surface via said first portion of the hook and loop fastening means of said third surface wherein said first, second, and third panels are disposed so as to form three overlapping layers for at least a portion thereof.

2. The window treatment of claim 1 wherein the support bar has a rectangular cross section.

3. The window treatment of claim 1 wherein said support bar further comprises a fourth surface disposed substantially parallel to said longitudinal axis and non-coplanar with respect said first, second, and third surfaces, said fourth surface comprising a first portion of a hook and loop fastening means covering most of said fourth surface for attachment thereto from a fourth direction, said fourth direction different from said first, second, and third directions.

4. The window treatment of claim 1 wherein said support bar is telescoping.

5. A telescoping window treatment support bar comprising:

an outer support bar frame having a hollow rectangular cross section, the outer frame having a top exterior surface, a bottom exterior surface, a front exterior surface, and a rear exterior surface;

an inner support bar frame having a rectangular cross section, the inner frame having a top exterior surface, a bottom exterior surface, a front exterior surface, and a rear exterior surface, such that the inner frame may slide inside the outer frame in order to provide an adjustable width support bar;

the first portion of a hook and loop fastening means integral to substantially all exterior surfaces of the outer support bar frame;

the first portion of a hook and loop fastening means integral to substantially all exposed exterior surfaces of the inner support bar frame;

a first mounting means such that one end of the outer support bar frame can be secured on one side of a window; and a second mounting means such that the exposed end of the inner support bar frame can be secured on the other side of the window.

6. The telescoping window treatment support bar of claim 5 wherein the first and second mounting means are punched metal end plates, such that the plates form a c-shaped opening to receive the support bar having a first end and a second end;

the end plates are secured to the wall;

the first end of the support par is placed and secured within the first end plate; and the second end of the support par is placed and secured within the second end plate.

7. A window treatment support bar assembly comprising:

a support bar having a longitudinal axis and a generally polygonal cross section generally normal to said longitudinal axis, said support bar having at least first, second, and third surfaces disposed substantially parallel to said longitudinal axis and non-coplanar with respect to each other;

said first surface comprising a first portion of a hook and loop fastening means covering most of said first surface for attachment thereto from a first direction;

said second surface comprising a first portion of a hook and loop fastening means covering most of said second surface for attachment thereto from a second direction, said second direction different from said first direction;

said third surface comprising a first portion of a hook and loop fastening means covering most of said third surface for attachment thereto from a third direction, said third direction different from both said first and second directions;

a first mounting means such that one end of the support bar can be secured on one side of a window; and a second mounting means such that the other end of the support bar can be secured on the other side of the window.

8. The window treatment support bar assembly of claim 7 wherein said support bar has a rectangular cross section.

9. The window treatment support bar assembly of claim 8 wherein said support bar has a back face, a top face, and a front face and wherein said first surface is disposed along said top face, said second surface is disposed along said top face, and said third surface is disposed along said front face.

10. The window treatment support bar assembly of claim 7 wherein said first, second, and third surfaces of said support bar are substantially covered with the hook portion of said hook and loop fastening means.

11. The window treatment support bar assembly of claim 7 wherein said support bar further comprises a fourth surface disposed substantially parallel to said longitudinal axis and non-coplanar with respect said first, second, and third surfaces, said fourth surface comprising a first portion of a hook and loop fastening means covering most of said fourth surface for attachment thereto from a fourth direction, said fourth direction different from said first, second, and third directions.

* * * * *